US007490990B2

(12) United States Patent
Moizumi

(10) Patent No.: US 7,490,990 B2
(45) **Date of Patent: *Feb. 17, 2009**

(54) INNER BAG FOR TRANSPORT TANK

(75) Inventor: Yoshitsugu Moizumi, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 578 days.

This patent is subject to a terminal disclaimer.

(21) Appl. No.: 11/033,833

(22) Filed: Jan. 13, 2005

(65) Prior Publication Data

US 2005/0184068 A1 Aug. 25, 2005

(30) Foreign Application Priority Data

Jan. 15, 2004 (JP) ..... 2004-008246
Mar. 5, 2004 (JP) ..... 2004-062780

(51) Int. Cl.
*B65D 33/16* (2006.01)
*B65D 30/08* (2006.01)

(52) U.S. Cl. ..... 383/67; 383/109

(58) Field of Classification Search ..... 383/67, 383/88, 66, 109
See application file for complete search history.

(56) References Cited

U.S. PATENT DOCUMENTS 3,167,209 A * 1/1965 Jones ..... 383/22
3,219,240 A * 11/1965 Campbell, Jr. ..... 222/183
4,671,733 A * 6/1987 Krein ..... 414/809
5,098,364 A * 3/1992 Schilling ..... 493/200
5,741,208 A * 4/1998 Moak ..... 493/195
6,203,089 B1 * 3/2001 Doolittle et al. ..... 296/39.1
6,626,312 B2 * 9/2003 Maturana ..... 220/1.6
7,086,429 B2 * 8/2006 Moizumi ..... 141/114

FOREIGN PATENT DOCUMENTS

| | | |
|---|---|---|
| DE | 88 07 196 | 2/1989 |
| EP | 0 303 160 | 2/1989 |
| JP | 50-4615 | 1/1975 |
| JP | 57-46492 U | 3/1982 |
| JP | 61-48190 U | 3/1986 |
| JP | 61-104983 A | 5/1986 |
| JP | 2001-354292 A | 12/2001 |
| WO | WO-84/02509 | 7/1984 |
| WO | WO-91/06490 | 5/1991 |

* cited by examiner

*Primary Examiner*—Jes F Pascua
(74) *Attorney, Agent, or Firm*—Birch, Stewart, Kolasch & Birch, LLP

(57) ABSTRACT

An envelope type inner bag body is produced by welding both ends of a tubular film. A supply-discharge opening is welded at a position apart from one end portion of the inner bag body by a distance about IW/2 to form an inner bag for a transport tank, which is loaded in a cylindrical tank body. When length of the inner bag body is IL, width thereof is IW, inner peripheral length of the transport tank in a longitudinal cross-sectional surface in a longitudinal direction is TLt, and inner peripheral length of the transport tank in a longitudinal cross-sectional surface in a width direction is TLr, IL and IW satisfy the conditions: $0.47 \cdot TLt \leqq IL \leqq 0.6 \cdot TLt$, and $0.47 \cdot TLr \leqq IW \leqq 0.6 \cdot TLr$. The envelope type inner bag will be appropriate in size with respect to the transport tank, eliminating the filling failure of the liquid and the breakage of the inner bag.

10 Claims, 9 Drawing Sheets

INNER BAG FOR TRANSPORT TANK

BACKGROUND OF THE INVENTION

1. Field of the Invention

The present invention relates to an inner bag for a transport tank, and more specifically, to an envelope type inner bag which is formed to fit the size of the transport tank.

2. Description of the Prior Arts

In cargo transportation by sea, railroad, road and so forth, a tank container is generally used for liquid materials (cargo). As the tank container, a 20 foot container (hereinafter referred to as a tank container) which conforms to the ISO Standards is ordinarily used, for example. The tank container has 20 foot length, 8 foot width, and 8 foot height, so that about 20 tons of liquid can be filled therein.

In the container transportation to use this kind of tank container, it is necessary to wash the inside of the tank after transportation, and in addition, to produce the tank by using a high quality stainless steel plate with chemical resistance. In order to solve the problems, Japanese Patent Laid-Open Publication No.S61-104983 discloses that an inner bag or liner bag made of soft synthetic resin to have the chemical resistance is loaded in the tank produced from the general steel plate. In addition, Japanese Patent Laid-Open Publication No. 2001-354292, Japanese Utility-Model Laid-Open Publication No.S61-48190, Japanese Patent Laid-Open Publication No.S50-4615, and Japanese Utility-Model Laid-Open Publication No.S57-46492 also disclose to load the inner bag in the tank in order to save the trouble for washing the inside of the tank.

However, with respect to the prior art inner bag to be used in the tanks and tank containers, it is so difficult to produce appropriate inner bags for large tanks including the 20 foot container that there has no practical application. Namely, it has been difficult to produce the inner bag fitting in the cylindrical 20 foot container easily and affordably. The ideal inner bag to fit within the tank container properly would be a cylindrical-shaped inner bag having approximately the same shape as the tank container. However, it is necessary to prepare circular lid films, and in addition, to weld the circular lid films on both ends of a tubular film. To make matters worse, since the circular lid film has to be welded not in a two-dimensional direction, but in a three-dimensional direction, the exclusive guide apparatus for welding the circular lid film is required.

In contrast, an envelope type inner bag is easily produced only by welding the both ends of the tubular film. This type of inner bag prevents the liquid from directly contacting with the inside of the tank by joining supply-discharge openings of the inner bag and the tank. Therefore, changing the inner bag makes it unnecessary to wash the inside of the tank. However, since the tank container is cylindrical, if the envelope type inner bag is loaded therein, the following problem occurs due to the difference in shape between them. The envelope type inner bag is sealed only by a welding line on each end. If the inner bag is not long enough, a gap is created between the tank container and the inner bag even if it is filled with liquid. An inertia force of the liquid in transporting concentrates as a load between the inner bag and the supply-discharge opening due to the gap. The inner bag may be torn at both the ends. Meanwhile, if the inner bag is unnecessarily long, it becomes impossible to adequately feed the liquid in folded portions at both ends of the inner bag because the folded portions are pressed down by the weight of the liquid already fed in, even before it is filled with the liquid. Accordingly, even if the inner bag has an enough capacity, a necessary amount of liquid cannot be filled therein. If the liquid is kept fed in the inner bag in a state where the folded portions are pressed down, the internal pressure of the inner bag becomes high to damage the inner bag. Although the envelope type inner bag is easily produced, if the inner bag is not formed to have the appropriate size for fitting in the tank container, the filling failure and the breakage of the inner bag may occur.

SUMMARY OF THE INVENTION

An object of the present invention is to provide an envelope type inner bag for a transport tank in which filling failure and breakage of the inner bag are prevented.

In order to achieve the above object, an inner bag for the transport tank of the present invention includes a synthetic-resin inner bag body having an envelope shape and a second supply-discharge opening fitted in a first supply-discharge opening of the transport tank. Filler is filled in the inner bag body through the second supply-discharge opening. When the length of the inner bag body is IL, the width thereof is IW, the inner peripheral length of the transport tank in the longitudinal cross-sectional surface in the longitudinal direction is TLt, and the inner peripheral length of the transport tank in the longitudinal cross-sectional surface in the width direction is TLr, IL and IW satisfy the following conditions: $0.47 \cdot TLt \leqq IL \leqq 0.6 \cdot TLt$, and $0.47 \cdot TLr \leqq IW \leqq 0.6 \cdot TLr$.

According to the preferred embodiment of the present invention, IL and IW satisfy the following conditions: $0.49 \cdot TLt \leqq IL \leqq 0.55 \cdot TLt$, and $0.49 \cdot TLr \leqq IW \leqq 0.58 \cdot TLr$. The second supply-discharge opening is provided on a central line extending in the longitudinal direction at a position apart from one end of the inner bag body by a distance L1 or adjacent thereto. The distance L1 satisfies the condition: $0.44 \cdot IW \leqq L1 \leqq 0.50 \cdot IW$. With the second supply-discharge opening directed downward, both side edges of the inner bag body are folded inward an appropriate number of times in parallel with a central line extending in the longitudinal direction of the inner bag body. Then both ends of the inner bag body are folded inward or rolled toward the second supply-discharge opening in parallel with a central line extending in the width direction so that the inner bag body is folded up. By the filling of the filler, the folded inner bag except both side edges opens up in the longitudinal direction. The inner bag body has a multilayer structure formed by welding both ends of a multilayer tubular film which is constituted of inner and outer tubular films.

According to the present invention, since the inner bag is formed to have the envelope shape, it is unnecessary to shape an inner bag body into tube to have the approximately same shape as the transport tank. It is necessary only to weld both the ends of the tubular film, so that the inner bag body can be produced easily. When the length of the inner bag body is IL, the width thereof is IW, the inner peripheral length of the transport tank in the longitudinal cross-sectional surface in the longitudinal direction is TLt, and the inner peripheral length of the transport tank in the longitudinal cross-sectional surface in the width direction is TLr, IL and IW satisfy the following conditions: $0.47 \cdot TLt \leqq IL \leqq 0.6 \cdot TLt$, and $0.47 \cdot TLr \leqq IW \leqq 0.6 \cdot TLr$, that enables to produce the envelope type inner bag body of appropriate size. As a result, it is possible to prevent the filling failure and the damage of the inner bag when the envelope type inner bag body is loaded in the approximately tubular transport tank.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
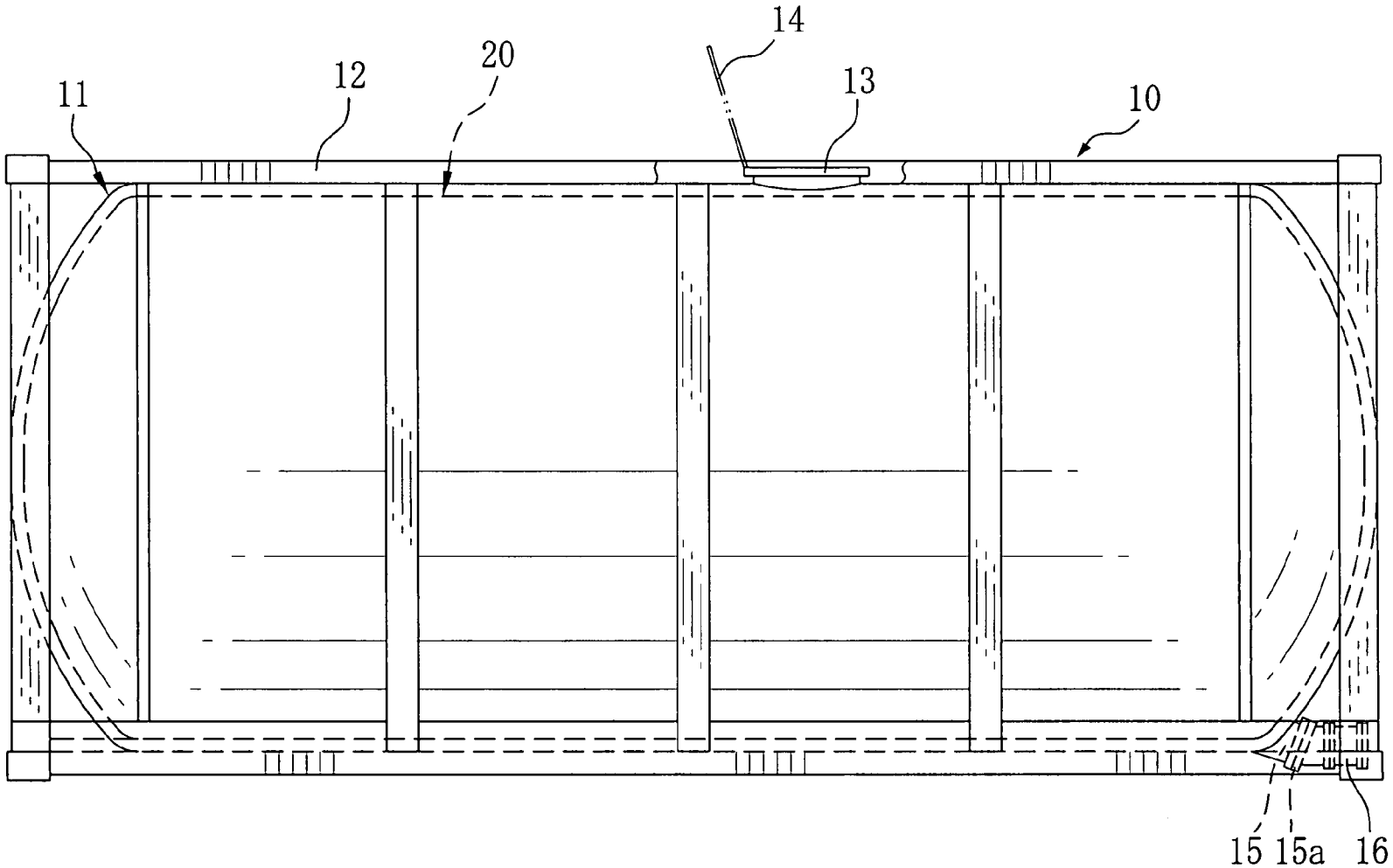
FIG. 1 is a front view of a tank container in which an inner bag for a transport tank of the present invention is loaded.

In FIG. 1, a twenty-foot ISO container 10 is constituted of a tank body 11 and a rectangular parallelepiped frame 12 for holding the tank body 11. A hatch 13 is formed at the top face of the tank body 11. The maintenance and filling of liquid are performed through the hatch 13. At the time of transporting, a lid 14 is locked by a locking member in order to prevent the lid 14 covering the hatch 13 from opening. A tank supply-discharge opening 15 is formed in one end of a lower portion of the tank body 11. A foot valve 16 is fixed through a flange 15*a* of the tank supply-discharge opening 15.

An inner bag for a transport tank (hereinafter referred to as an inner bag) 20 is loaded into the tank body 11. The inner bag 20 is brought into the tank body 11 from the hatch 13 by an operating person to set in the tank body 11. The inner bag 20 upswells in the tank body 11 by pouring the liquid as cargo therein from the tank supply-discharge opening 15 through the foot valve 16, so that the inner bag 20 operates as a lining to the tank body 11.

Figure 2A:
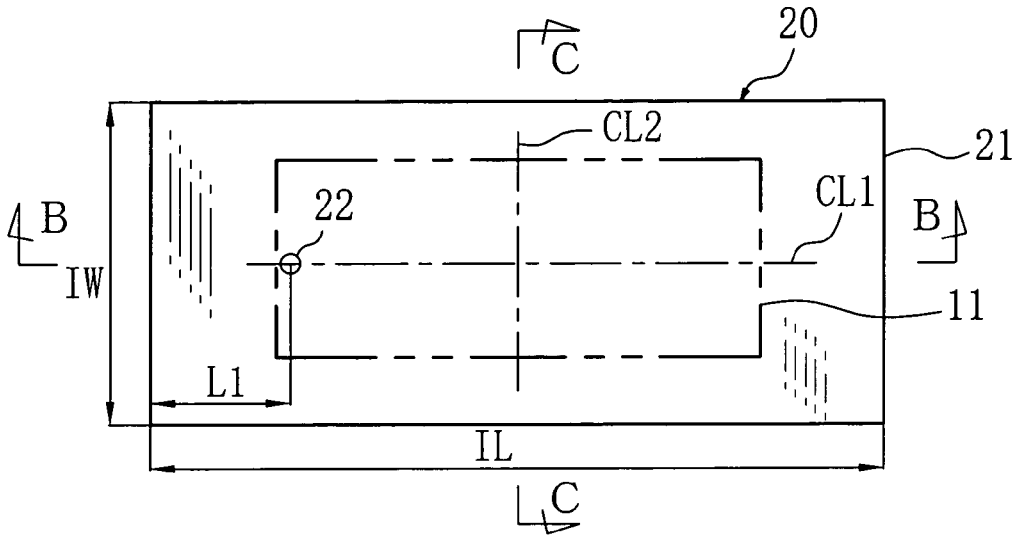
FIG. 2A is an explanatory view of the size of the inner bag fitting in a tank body of the transport tank, wherein a plan view of the tank body and the inner bag is shown.
Figure 3A:
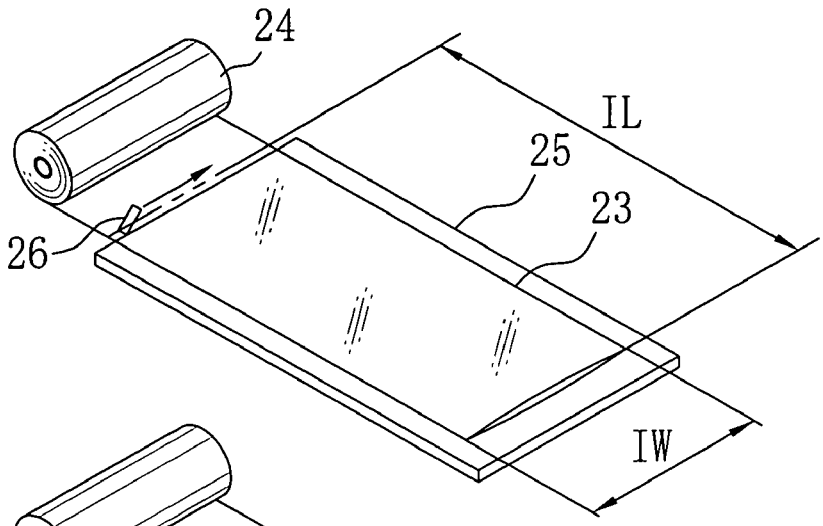
FIGS. 3A, 3B, 3C and 3D are schematic perspective views showing procedure for producing the inner bag.
Figure 3B:
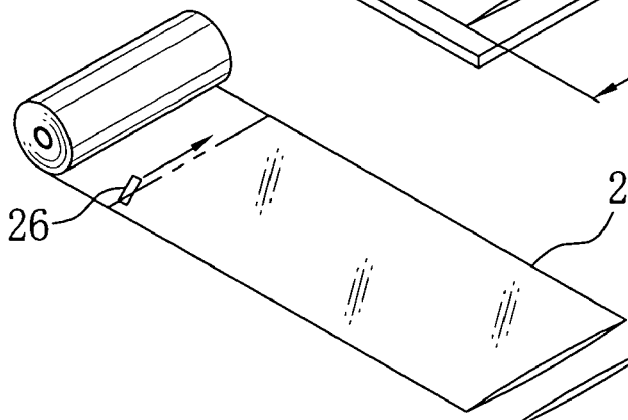

As shown in FIG. 2A, the inner bag 20 is constituted of an inner bag body 21 having an envelope shape and an inner bag supply-discharge opening 22 to be fitted in the tank supply-discharge opening 15. Since the inner bag 20 is formed to the envelope shape, the inner bag body 21 can be easily formed as shown in FIGS. 3A-3D. In FIG. 3B, a tubular film 23 is cut into a predetermined length after being drawn from a film roll 24 which is the roll of the tubular film 23, and then both end portions 23*a* and 23*b* of the tubular film 23 are closed by thermally welding or the like (see FIGS. 7A and 7C).

Figure 2B:
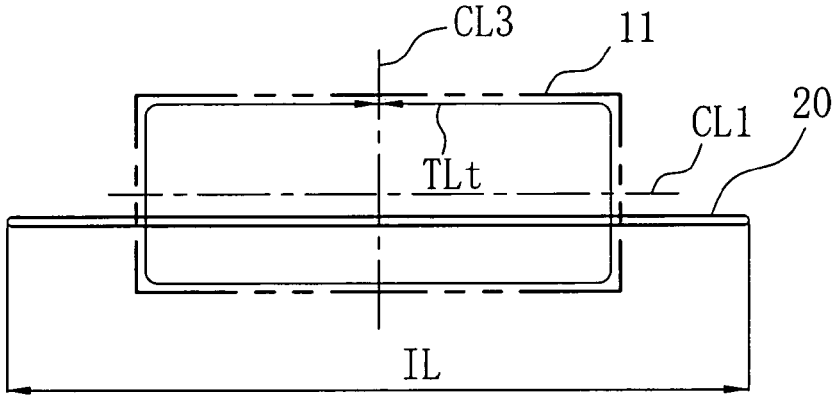
FIG. 2B is an explanatory view of the size of the inner bag fitting in the tank body, wherein a longitudinal cross-sectional surface of the tank body in a longitudinal direction is shown.
Figure 2C:
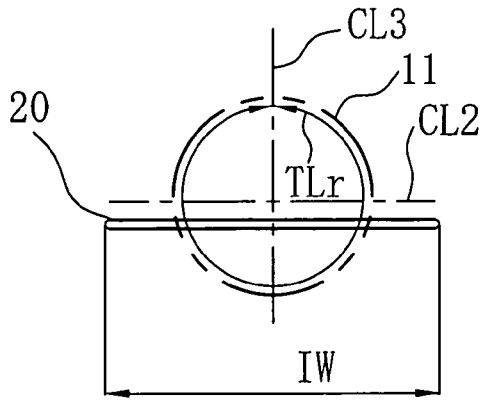
FIG. 2C is an explanatory view of the size of the inner bag fitting in the tank body, wherein a longitudinal cross-sectional surface of the tank body in a width direction is shown.

In FIG. 2A, a longitudinal cross-sectional surface including a central line CL1 extending in the longitudinal direction of the tank body 11 (B-B arrowed cross-section) is referred to as a longitudinal cross-sectional surface in the longitudinal direction, while a longitudinal cross-sectional surface including a central line CL2 extending in the width direction of the tank body 11 (C-C arrowed cross-section) is referred to as a longitudinal cross-sectional surface in the width direction. A line CL3 shown in FIG. 2B is a central line extending in a height direction of the tank body 11.

The tank body 11 is formed to a tubular shape whose both ends are closed to be placed transversally, while the inner bag 20 is formed to the envelope shape. Therefore, if the inner bag 20 is smaller than the appropriate size corresponding to the size of the tank body 11, a predetermined filling capacity is not ensured. To make matters worse, the smaller inner bag creates a gap between the inner peripheral surface of the tank body 11 and the inner bag 20 where the inner bag 20 together with the liquid can move to damage the welded portion of the inner bag supply-discharge opening 22 and the welded lines of the both ends of the inner bag 20. Whereas, if the inner bag 20 is larger than the appropriate size corresponding to the size of the tank body 11, the raw material of the inner bag 20 is wasted. Moreover, if an extra portion such as the end portion of the inner bag 20 is under the liquid filled in the inner bag 20, the extra portion is sandwiched between the inner bag body 21 filled with the liquid and the peripheral surface of the tank body 11 due to the weight of the liquid. As a result, it becomes impossible to fill liquid furthermore. If the liquid is kept filled while the extra portion is sandwiched, the internal pressure of the inner bag 20 rises to possibly damage the inner bag 20.

In the present embodiment, the size of the envelope type inner bag 20 is limited within a specific range based on the size of the tank body 11 for the purpose of preventing the filling failure and the damage of the inner bag 20. When the length of the inner bag 20 is IL, the width thereof is IW, the inner peripheral length (first inner peripheral length) of the tank body 11 in the longitudinal cross-sectional surface in the longitudinal direction is TLt, and the inner peripheral length (second inner peripheral length) of the tank body 11 in the longitudinal cross-sectional surface in the width direction is TLr, the following conditions are satisfied:

$$0.47 \cdot TLt \leqq IL \leqq 0.6 \cdot TLt; \text{ and}$$

$$0.47 \cdot TLr \leqq IW \leqq 0.6 \cdot TLr.$$

IL and IW preferably satisfy the following conditions:

$$0.49 \cdot TLt \leqq IL \leqq 0.55 \cdot TLt; \text{ and}$$

$$0.49 \cdot TLr \leqq IW \leqq 0.58 \cdot TLr.$$

As above-mentioned, the size of the inner bag 20 is limited based On the inner peripheral length of the tank body 11, so that the tank body 11 may have different shapes than tube such as an elliptical shape or others.

The inner bag supply-discharge opening 22 is provided on the central line extending in the longitudinal direction at a position apart from one end of the inner bag 20 by the distance L1=750 mm or adjacent thereto. The distance L1 is limited within a range 0.44·IW≦L1≦0.5 0·IW bas ed on the width IW of the inner bag 20, so that it is possible to position the central positions in the longitudinal direction of the tank body 11 and the inner bag 20 with each other if the inner bag 20 is attached to the tank body 11 with reference to the tank supply-discharge opening 15, which is formed in the end of the lower portion of the tank body 11. Thereby, the extra portions in both ends of the inner bag 20 can be distributed approximately evenly in the tank body 11. Accordingly, the extra portion of the inner bag 20 dose not build up on one side to be sandwiched between the tank body 11 and the inner bag body 21, so that the filling failure and the damage of the inner bag 20 are eliminated.

Figure 4:
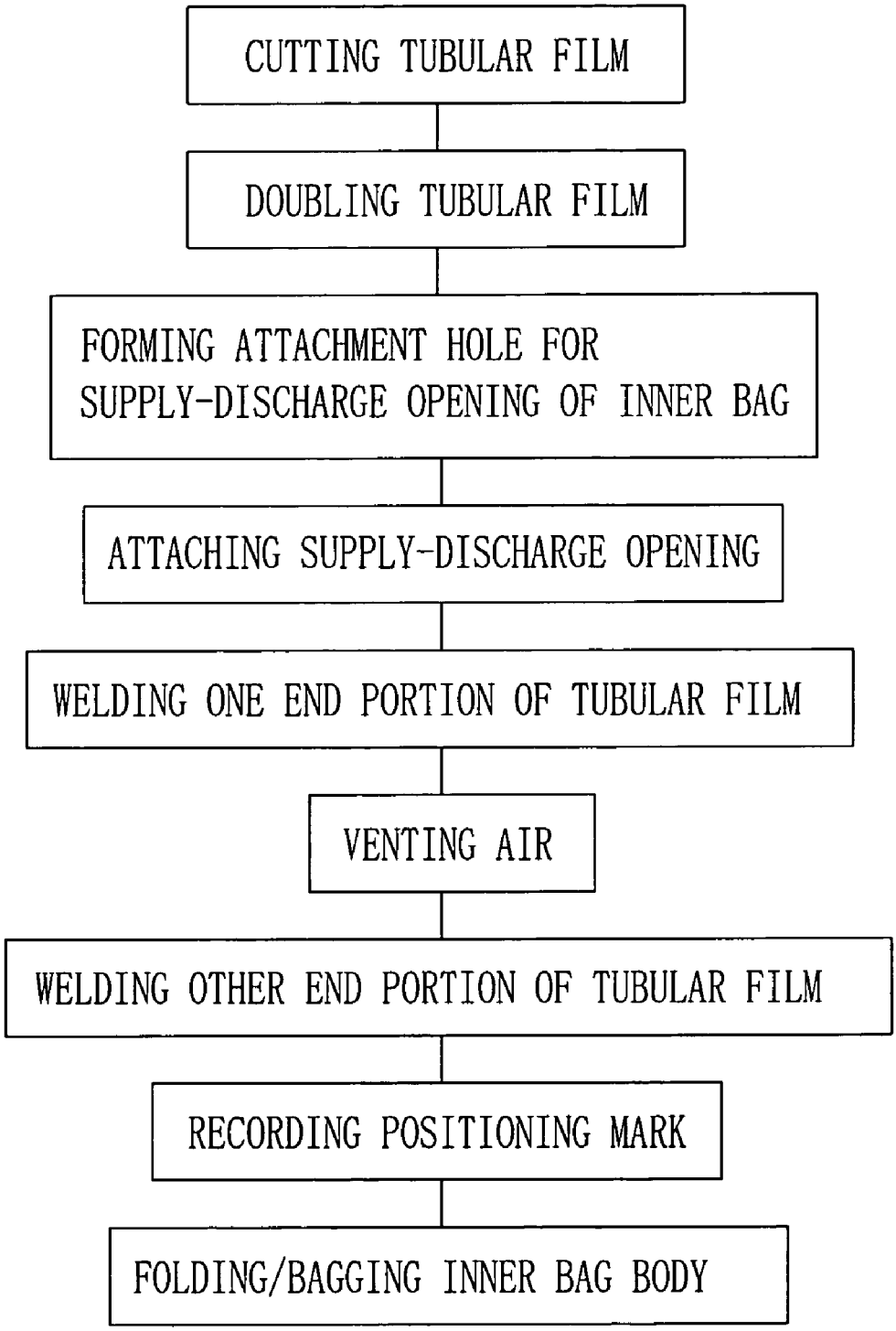
FIG. 4 is a flow chart showing the procedure for producing the inner bag.

Next, the procedure for producing the inner bag 20, which is shown in FIG. 4, is explained. As shown in FIGS. 3A and 3B, the tubular film 23 is drawn from the film roll 24 to be put on a work table 25, and then cut into the length IL by a cutter 26 or the like. The tubular film 23 is made from LLDPE (linear low density polyethylene), and wound into a roll shape to be stored. Since the inner bag 20 is doubled in the present embodiment, it is necessary to form the two tubular films 23 by cutting the tubular film 23 twice into the length IL. The inner bag 20 of the present invention is used for the 20 foot container, so that the first inner peripheral length TLt≈15500 mm, and the second inner peripheral length TLr≈7100 mm, while IL=8300 mm and IW=3900 mm based on the above-mentioned appropriate size range. The thickness of a single layer of the tubular film 23 is 120 μm. Since the tubular film 23 of the present embodiment has two layers, the entire thickness of the tubular film 23 is 240 μm. The thickness of the film is preferably 80-500 μm, especially 100-300 μm.

Figure 3C:
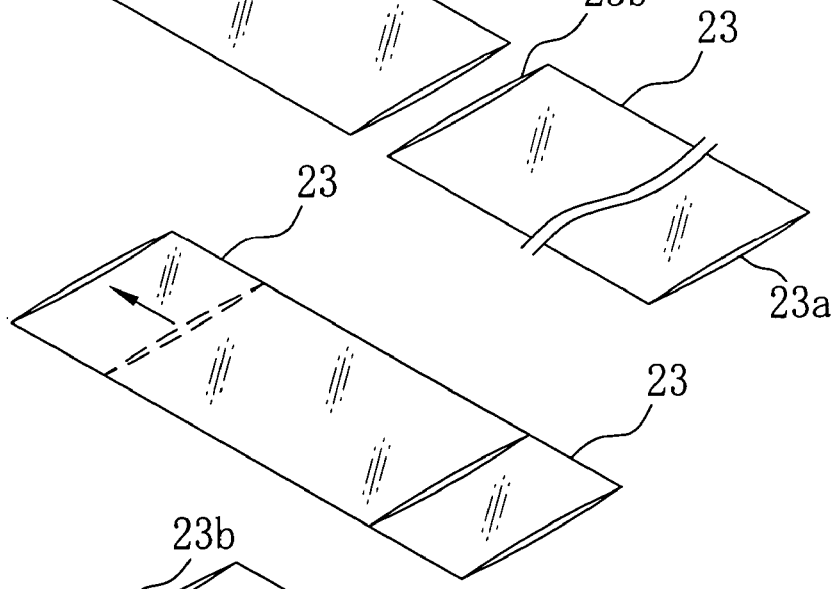
Figure 3D:
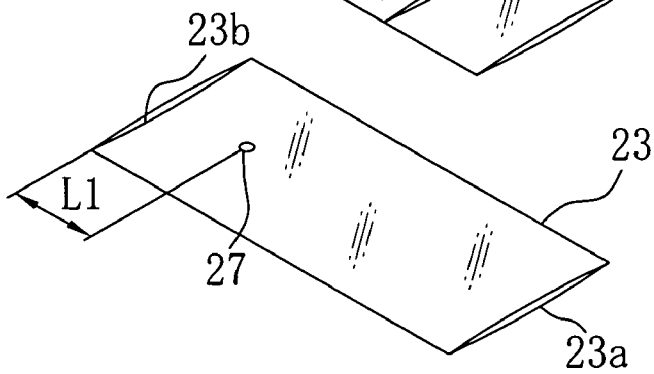

As shown in FIG. 3C, in doubling the tubular film 23, one tubular film is inserted into another tubular film. Subsequently, as shown in FIG. 3D, a hole 27 corresponding to the inner bag supply-discharge opening 22 is opened on only the upper two layers of films by a punch or a cutter. The inner bag supply-discharge opening 22 is located at the center in the width direction and apart from other end portion 23*b* by the distance L1=1750 mm.

Figure 5:
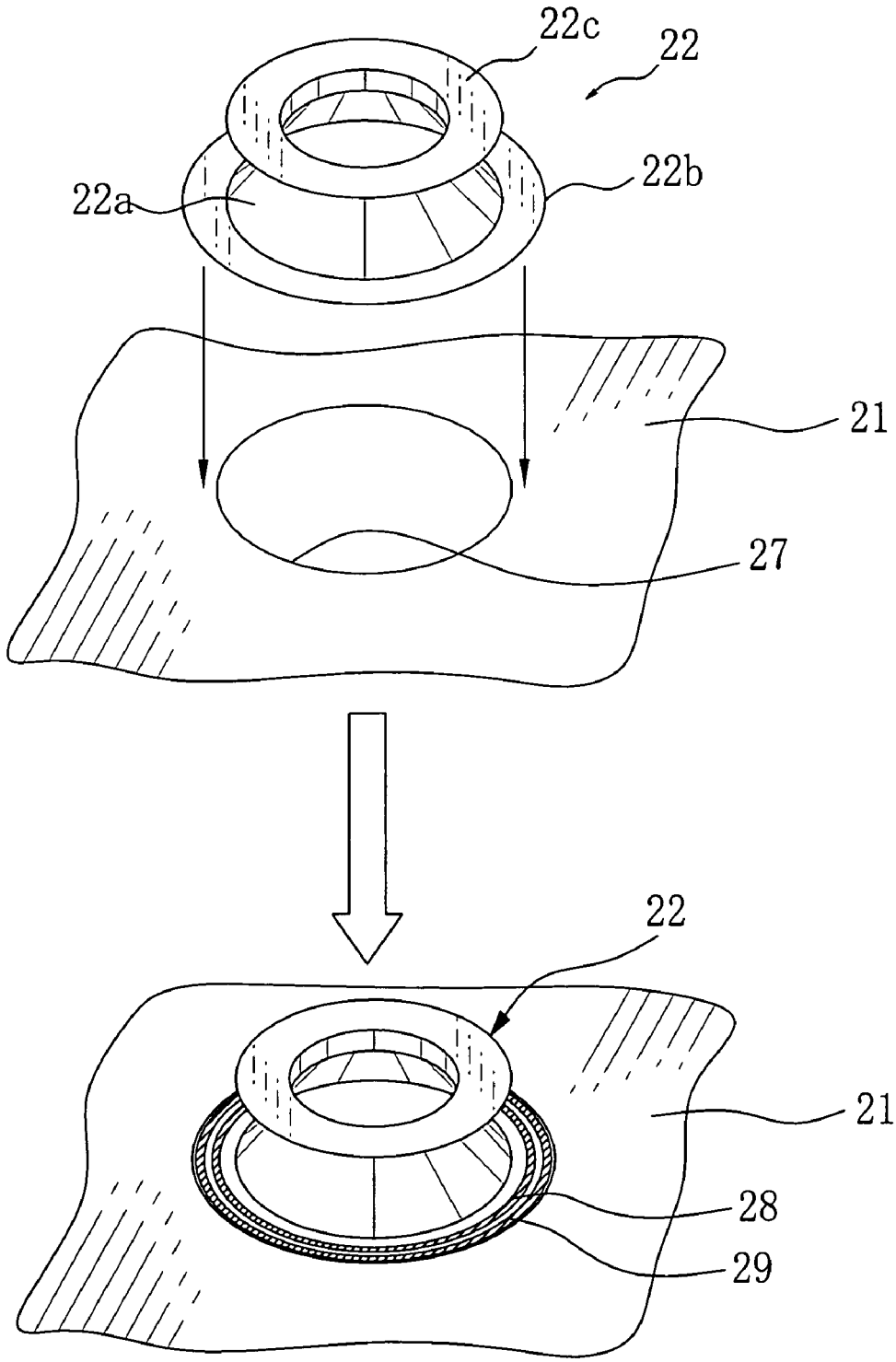
FIG. 5 is an explanatory view showing procedure for welding an inner bag supply-discharge opening.
Figure 6:
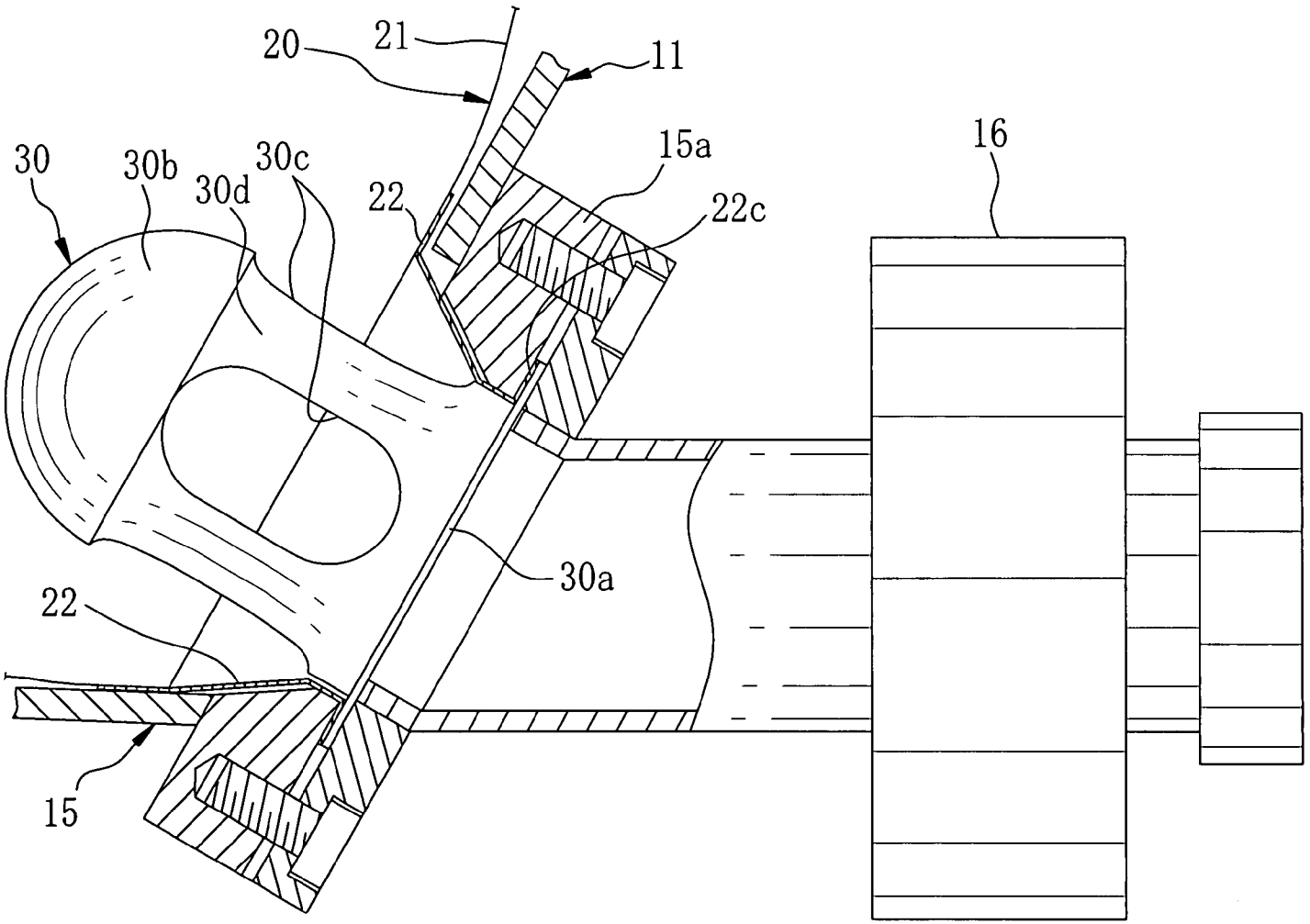
FIG. 6 is a cross-sectional view showing a state where the inner bag supply-discharge opening is attached to a tank supply-discharge opening.

As shown in FIG. 5, when the inner bag supply-discharge opening 22 is attached to the inner bag body 21, the opening 22 is thermally welded to a peripheral edge of the hole 27. At this time, only the upper two layers of the films are thermally welded. The inner bag supply-discharge opening 22 is constituted of a supply-discharge mouth 22*a* having a truncated conical and cylindrical shape, a welding flange 22*b* and an attachment flange 22*c* which are attached to both the ends of the supply-discharge mouth 22*a*, and integrally formed by using LLDPE for example. The welding flange 22*b* and the inner bag body 21 are thermally welded by a thermal welding apparatus (not shown) to form weld lines 28 and 29. As shown in FIG. 6, when the inner bag supply-discharge opening 22 is inserted to the tank supply-discharge opening 15 from the inside of the tank, the attachment flange 22*c* protrudes outside the flange 15*a* of the tank supply-discharge opening 15 to be fixed firmly to the flange 15*a*.

As shown in FIG. 6, a flange 30*a* of an inner bag suction preventing member 30 and the foot valve 16 are attached to the flange 15*a* of the tank supply-discharge opening 15, so that the inner bag supply-discharge opening 22 is attached firmly to the tank supply-discharge opening 15. The supply-discharge mouth 22*a* is formed along the inner peripheral surface of the tank supply-discharge opening 15.

Figure 7A:
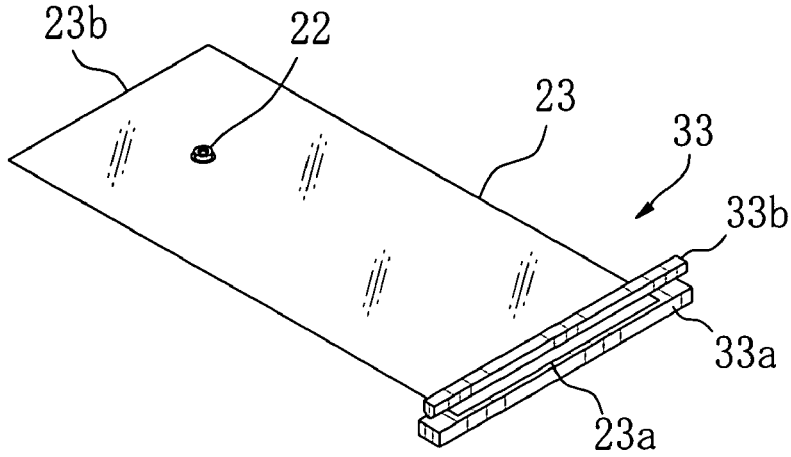
FIG. 7A is a perspective view showing process for welding one end of a tubular film.

As shown in FIG. 7A, in welding the one end portion of the tubular film 23, all four layers of films in the end portion 23*a* of the tubular film 23 are thermally welded simultaneously by the thermally welding apparatus 33 to seal the end portion 23*a*. The thermally welding apparatus 33 is constituted of a receiving stage 33*a* and a welding head 33*b*. The heat is applied to the end portion 23*a*, which is held by the welding head 33*b* and the receiving stage 33*a* after the welding head 33*b* has been moved down.

Figure 8A:
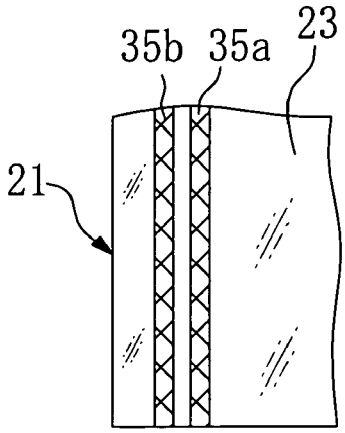
FIG. 8A is an enlarged plan view showing a welding line of the inner bag, wherein the inner and outer tubular films are thermally welded all together into four layer.
Figure 8B:
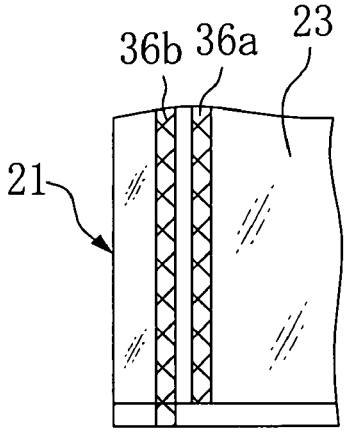
FIG. 8B is an enlarged plan view showing the welding line of the inner bag, wherein the inner and outer tubular films are thermally welded all together into four layer after the end of the inner tubular film have been thermally welded into two layer.
Figure 8C:
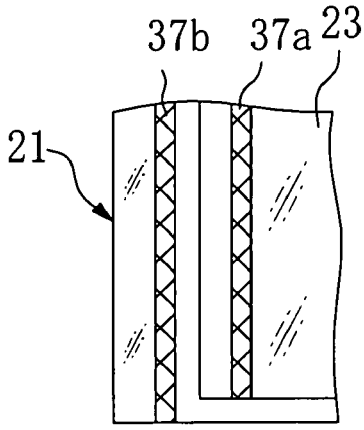
FIG. 8C is an enlarged plan view showing the weld line of the inner bag, wherein the ends of the inner and outer tubular films are thermally welded together into two layer.

As shown FIGS. 8A-C, two stripes of thermal welding lines 35*a* and 35*b* of 5 mm in width are formed linearly at an interval of 5-10 mm. Note that one or three or more thermal welding lines may be formed. In addition, a corrugated thermal welding line may be applied to the present embodiment instead of the linear one. If the plural thermal welding lines are formed, all lines may be formed together, or each line may be formed one by one. In FIG. 8B, a thermal welding line 36*a* is formed by welding the one end portion of the inner tubular film 23 into two layer, and then a thermal welding line 36*b* is formed by welding the one end portion of both the inner and outer tubular films 23 into four layer. The thermal welding line 36*b* is positioned outside the thermal welding line 36*a*. In FIG. 8C, thermal welding lines 37*a* and 37*b* are formed by welding each end portion of the tubular film 23 into two layer separately wherein the inner tubular film is slightly shorter in length than the outer one. Although the thermal welding line may be welded at a time, if the length of the welding head 33*b* is limited, the thermal welding line may be welded sequentially every length of the welding head 33*b*. Note that ultrasonic welding or other welding method may be applied to the present embodiment instead of the thermal welding by using the heat-sealing type thermal welding apparatus 33.

Figure 7B:
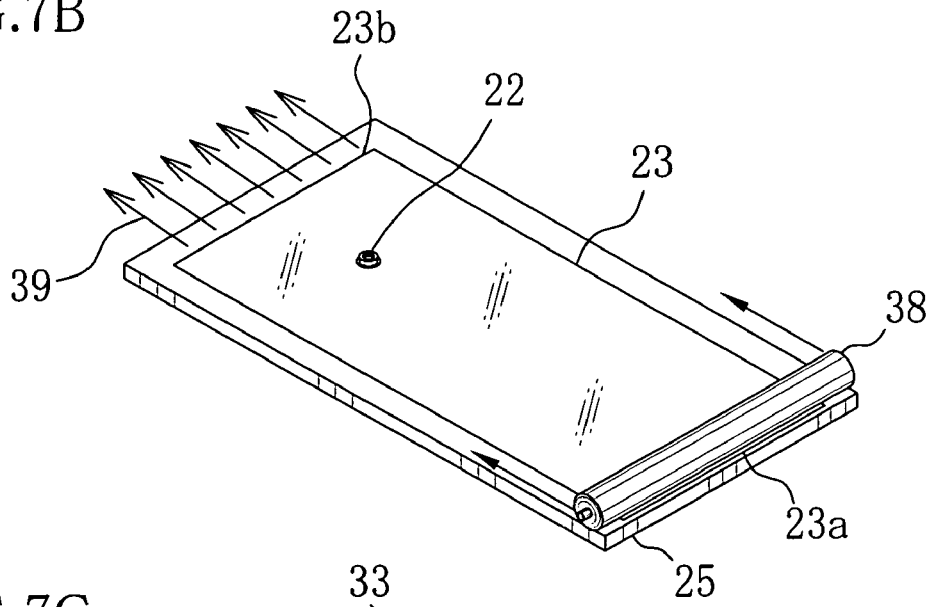
FIG. 7B is a perspective view showing process for venting air from the tubular film.

As shown in FIG. 7B, a pressing roller 38 is rotated on the work table 25 from the welded end portion 23*a* toward the other end portion 23*b* to vent air 39 in the doubled tubular film 23. Instead of rotating the pressing roller 38, the air may be vented by folding the inner bag body 21 from one end side to the other end side. Since the inner bag supply-discharge opening 22 is attached close to the other end portion 23*b* so as to protrude from the inner bag body 21, the air between the inner bag supply-discharge opening 22 and the other end portion 23*b* is vented by using a small roller for avoiding the supply-discharge opening 22.

Figure 7C:
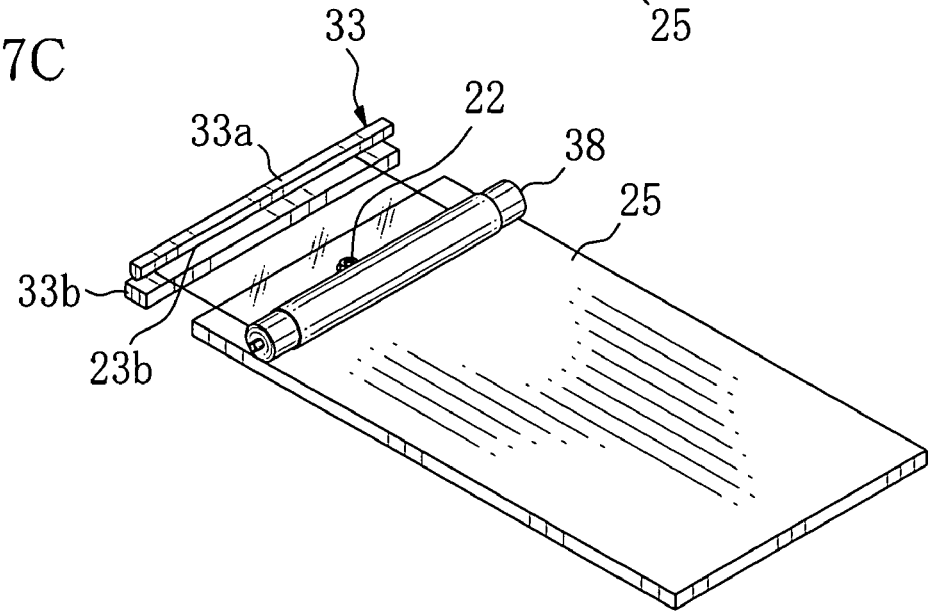
FIG. 7C is a perspective view showing process for welding the other end of the tubular film after the air venting.
Figure 9A:
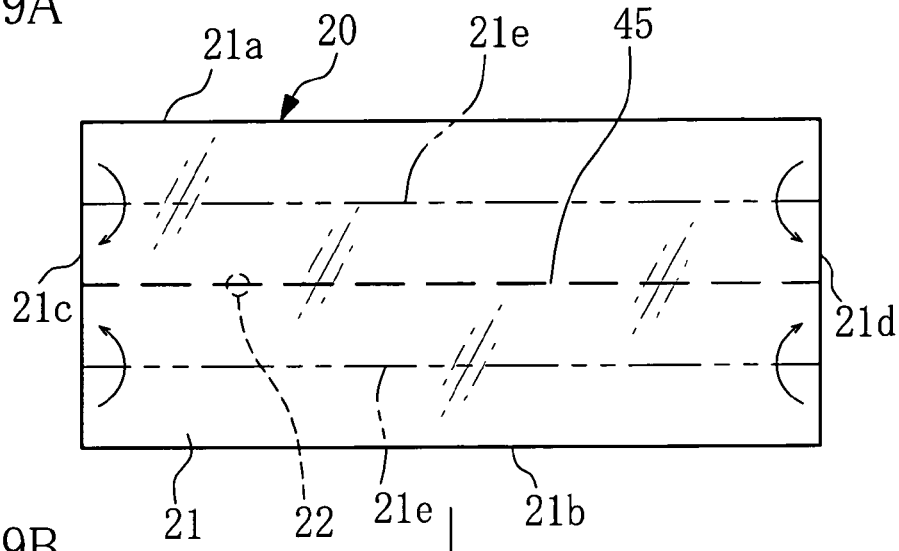
FIGS. 9A, 9B, 9C, 9D and 9E are explanatory views showing process for folding the inner bag to contain it in a packaging bag.
Figure 9B:
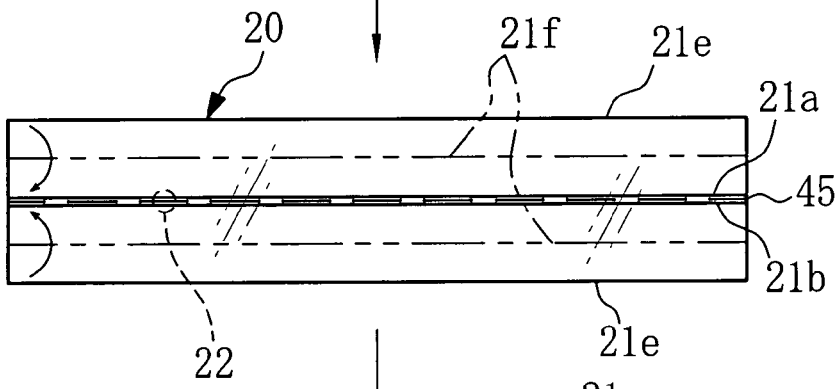
Figure 9C:
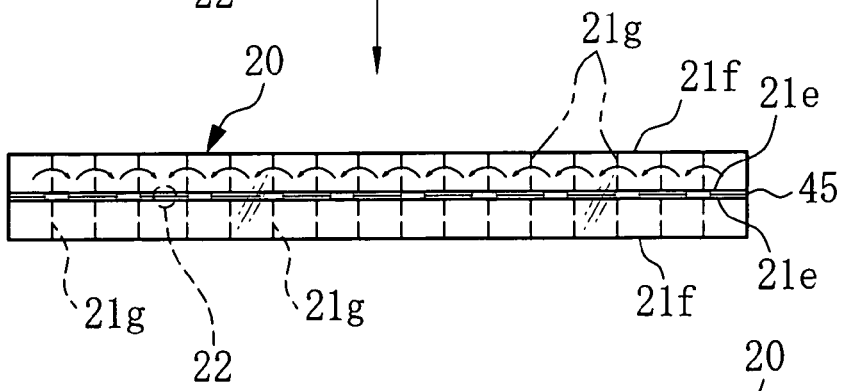
Figure 9D:
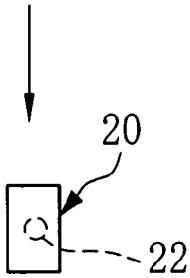
Figure 9E:
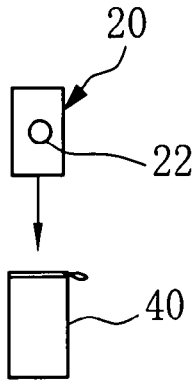

As shown in FIG. 7C, the other end portion 23*b* of tubular film 23, in which the air has been vented, is welded by the thermal welding apparatus 33 as well as the case of the end portion 23*a*. Thereby, the inner bag 20 shown in FIG. 9A is completed. A positioning mark 45 is recorded thereon along a central line extending in the longitudinal direction of the inner bag 20 by using an oil-based ink or the like. The inner bag body 21 is folded, and then contained in a packaging bag 40 as shown in FIG. 9E. Although the positioning mark 45 is formed linearly in the present embodiment, the shape or size of the positioning mark is not limited especially.

As shown in FIG. 9A, the inner bag body 21 with the supply-discharge opening 22 directed downward is folded inward along inward folding lines 21*e* in parallel with the positioning mark 45 so as to make both the side edge portions 21*a* and 21*b* approach the central line. Likewise, as shown in FIG. 9B, the inward-folded portions are folded inward again along inward folding lines 21*f* in parallel with the central line extending in the longitudinal direction so as to make the inward folding line 21*e* approach the central line. Thereby, the inner bag body 21 is double folded. Subsequently, as shown in FIG. 9C, the inner bag body 21 is folded plural times along the inward folding lines 21*g* toward the inner bag supply-discharge opening 22 from both the end portions 21*c* and 21*d* of the inner bag body 21, so that the inner bag body 21 is folded into a small size as shown in FIG. 9D. The inner bag body 21 may be rewound from the one end to be a roll shape instead of being folded inward along the inward folding lines 21*g*. After folding the inner bag body 21 into the small size, the inner bag 20 is put in the packaging bag 40 as shown in FIG. 9E. Since the inner bag body 21 is double folded along the inward folding lines 21*e* and 21*f*, it can be contained compactly. Note that the inner bag body 21 may be folded once or three times and above along the central line extending in the longitudinal direction.

As aforementioned, since the inner bag body 21 is folded such that the inner bag supply-discharge opening 22 is directed outside the inner bag body 21, the inner bag supply-discharge opening 22 can be inserted to the tank supply-discharge opening 15 easily. In addition, the inner bag body 21 is folded inward along the inward folding lines 21*g*, so that the inner bag body 21 can be expanded easily in the longitudinal direction of the tank body 11 in a state that the inner bag supply-discharge opening 22 is set in the tank supply-discharge opening 15. Furthermore, since the inner bag body 21 is folded inward along each of the inward folding lines 21*e* and 21*f* in a state that the inner bag supply-discharge opening 22 is directed downward, the inner bag body 21 is expanded by itself by filling the liquid from the inner bag supply-discharge opening 22.

Next, the method of loading the inner bag body 21 in the tank body 11 is explained. First, the inner bag 20 in the packaging bag 40 is brought into the tank body 11 by the operating person to be taken out of the packaging bag 40. The positioning mark 45 is recorded linearly on the inner bag 20 so as to correspond to the central line CL1 extending in the longitudinal direction of the tank body 11. After the foot valve 16 has been removed from the flange 15*a* of the tank supply-discharge opening 15, the inner bag supply-discharge opening 22 is inserted in the tank supply-discharge opening 15 so as to conform the positioning mark 45 to the central line CL1. Thereby, the attachment flange 22*c* is attached firmly to the flange 15*a*. Second, the inner bag body 21 folded along the inward folding lines 21*g* is unfolded in the longitudinal direction of the tank body 11, and then the folded portions along the inward folding line 21*f* are unfolded. Both the side edge portions which is folded along the inward folding lines 21*e* are not unfolded. Since the approximately overall width of the inside of the tank body 11 is covered by the inner bag body 21 of which the both side edge portions are folded along the inward folding lines 21*e*, even if the both side edge portions are unfolded, they are folded again by their weight. After unfolding the inner bag body 21 except for both the side edge portions, the inner bag suction preventing member 30 and the foot valve 16 are attached to the tank supply-discharge opening 15 from the outside of the tank body 11 as shown in FIG. 6.

The liquid as the cargo is filled from the tank supply-discharge opening 15. The filling speed is 50 liters per minute, for example. The inner bag body 21 is extended in the longitudinal direction in the tank body 11, so that the inner bag body 21 upswells by filling the liquid in the inner bag body 21 smoothly. The both side edge portions of the inner bag body 21, which are folded inward, are gradually unfolded with the filling of the liquid, so that the end portions of the inner bag body 21 are not accidentally caught between the inner bag body 21 and the tank body 11 by the weight of the portion in which the liquid is filled. Therefore, the inner bag body 21 upswells smoothly by the filling of the liquid. In a full filled state, about 20 tons of liquid is contained in the inner bag body 21.

In the present embodiment, the inner bag body 21 is loaded in the tank body 11 to extend in the longitudinal direction, and its side edge portions are folded inward toward the central line extending in the width direction of the inner bag body 21. That prevents the air from entering the inner bag body 21 and the inner bag body 21 can be used for the anaerobic liquid. In addition, since the inner bag body 21 and the inner bag supply-discharge opening 22 are made from LLDPE having high chemical resistance, the tank body 11 has more choices in material. Furthermore, it is unnecessary to line the inner peripheral surface of the tank body 11 with fluorocarbon resin such as polytetrafluoroethylene.

When the inner bag body 21 dwindles to close with the inner bag supply-discharge opening 22 after the remaining amount of the liquid is reduced, the inner bag body 21 may be accidentally sucked into the inner bag supply-discharge opening 22 to cover the opening 22. In order to prevent the inner bag body 21 from covering the inner bag supply-discharge opening 22 in discharging the liquid from the tank supply-discharge opening 15, when the liquid is discharged from the tank supply-discharge opening 15, a passage between the inner bag body 21 and the inner bag supply-discharge opening 22 is ensured by the inner bag suction preventing member 30. The inner bag suction preventing member 30 is integrally constituted of a semi-spherical end 30*b* arranged to protrude toward the inside of the tank body 11, a tubular portion 30*d* whose peripheral surface has plural continuous holes 30*c*, and an attachment flange 30*a* provided on the base of the tubular portion 30*d*. The semi-spherical end 30*b* protrudes toward the inside of the inner bag body 21, so that the residual liquid in the inner bag body 21 can be surely discharged through the continuous holes 30*c* without the inner bag body 21 stick to the inner bag supply-discharge opening 22.

In addition to the inner bag supply-discharge opening 22, an air vent cap and an air vent valve (not shown) may be welded to the inner bag body 21 at a position corresponding to the hatch 13. In this case, if the air enters the inner bag body 21 by the operation of loading the inner bag body 21 or filling the liquid, the air can be vented easily.

In the above embodiment, the inner bag body 21 is made from LLDPE, it may be made from LDPE (low-density polyethylene), OP (biaxially oriented polypropylene) and other synthetic resin. In addition, although the inner bag body 21 is doubled in the present embodiment, it may have a multilayer or single-layer structure. Furthermore, the inner bag 20 may be used not only for the tank container, but also for a tanker lorry and so forth.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An inner bag to be loaded in an approximately cylindrical transport tank in a removable manner, comprising:

an inner bag body having an envelope shape, wherein length of said inner bag body is IL, width thereof is IW, an inner peripheral length of said transport tank in a longitudinal cross-sectional surface in a longitudinal direction is TLt, and the inner peripheral length of said transport tank in the longitudinal cross-sectional surface in a width direction is TLr, the following conditions are satisfied:

$$0.47 \cdot TLt \leqq IL \leqq 0.6 \cdot TLt,$$

$$0.47 \cdot TLr \leqq IW \leqq 0.6 \cdot TLr; \text{ and}$$

a second supply-discharge opening to be fitted in a first supply-discharge opening formed in one end of a lower portion of said transport tank, filler being filled in said inner bag body through said second supply-discharge opening.

2. The inner bag as claimed in claim 1, wherein IL and IW satisfy the following conditions: $0.49 \cdot TLt \leqq IL \leqq 0.55 \cdot TLt$, $0.49 \cdot TLr \leqq IW \leqq 0.58 \cdot TLr$.

3. The inner bag as claimed in claim 2, wherein said second supply-discharge opening is provided on a central line extending in the longitudinal direction at a position apart from one end of said inner bag body by a distance L1 or adjacent thereto, said L1 satisfies the condition: $0.44 \cdot IW \leqq L1 \leqq 0.50 \cdot IW$.

4. The inner bag as claimed in claim 3, wherein said inner bag body is folded inward or rolled toward said second supply-discharge opening from both ends of said inner bag body in parallel with a central line extending in the width direction of said inner bag body after both side edges of said inner bag body are folded inward an appropriate number of times in parallel with a central line extending in the longitudinal direction of said inner bag body in a state that said second supply-discharge opening is directed downward.

5. The inner bag as claimed in claim 4, wherein said inner bag body and said second supply-discharge opening are made from synthetic resin.

6. The inner bag as claimed in claim 5, wherein said inner bag body has a multilayer structure formed by welding both ends of a multilayer tubular film which is constituted of an inner tubular film and an outer tubular film.

7. An inner bag to be loaded in an approximately cylindrical transport tank in a removable manner, comprising:

an inner bag body having an envelope shape, wherein length of said inner bag body having an envelope shape, wherein length of said inner bag body is IL, width thereof is IW, an inner peripheral length of said transport tank in a longitudinal cross-sectional surface in a longitudinal direction is TLt, and the inner peripheral length of said transport tank in the longitudinal cross-sectional surface in a width direction is TLr, the following conditions are satisfied:

$$0.47 \cdot TLt \leqq IL \leqq 0.6 \cdot TLt,$$

$$0.47 \cdot TLr \leqq IW \leqq 0.6 \cdot TLr; \text{ and}$$

a second supply-discharge opening to be fitted in a first supply-discharge opening formed in one end of a lower portion of said transport tank, filler being filled in said inner bag body through said second supply-discharge opening, wherein the inner bag body includes an inner tubular film and an outer tubular film and is seamless in the longitudinal direction.

8. The inner bag body as claimed in claim 7, wherein the inner bag body includes at least one thermal welding line sealing each end of the inner and outer tubular film.

9. The inner bag body as claimed in claim 7, wherein the inner bag body includes at least one thermal welding line sealing each end of the inner tubular film.

10. The inner bag body as claimed in claim 7, wherein the inner bag body includes at least one thermal welding line sealing each end of the inner tubular film, at least one thermal welding line sealing each end of the outer tubular film and the inner tubular film slightly shorter in length than the outer tubular film.

* * * * *